US008800403B2

(12) United States Patent
Gargaro, III et al.

(10) Patent No.: US 8,800,403 B2
(45) Date of Patent: Aug. 12, 2014

(54) BOAT LIFT DRIVE HOUSING APPARATUS

(75) Inventors: Nicholas A. Gargaro, III, Coon Rapids, MN (US); David M. Wendinger, Isanti, MN (US)

(73) Assignee: Nicholas A. Gargaro, III, Coon Rapids, MN (US)

( * ) Notice: Subject to any disclaimer, the term of this patent is extended or adjusted under 35 U.S.C. 154(b) by 835 days.

(21) Appl. No.: 12/885,200

(22) Filed: Sep. 17, 2010

(65) Prior Publication Data

US 2012/0070230 A1 Mar. 22, 2012

(51) Int. Cl.

| | |
|---|---|
| ***F16H 57/02*** | (2012.01) |
| ***E05B 17/04*** | (2006.01) |
| ***E05B 17/18*** | (2006.01) |
| ***B65D 51/18*** | (2006.01) |
| ***B65D 55/14*** | (2006.01) |

(52) U.S. Cl.
USPC ..... 74/606 R; 310/89; 70/423; 70/455; 220/254.3; 220/210

(58) Field of Classification Search
USPC ..... 74/606 R, 89.13, 89.14, 425, 421 A; 114/44, 51; 405/3; 310/89; 70/424–428, 454, 455; 464/89–91; 220/254.3, 254.1, 259.1, 256.1; 361/600, 679.01; 312/223.1, 223.2, 312/223.3, 136; 224/251, 904, 148.4
See application file for complete search history.

(56) References Cited

U.S. PATENT DOCUMENTS

| | | | | | |
|---|---|---|---|---|---|
| 1,593,398 | A * | 7/1926 | Eubanks | 70/454 |
| 4,107,967 | A * | 8/1978 | Grabb | 70/427 |
| 4,454,801 | A * | 6/1984 | Spann | 91/375 A |
| 4,825,673 | A * | 5/1989 | Drake | 70/455 |
| 4,884,424 | A * | 12/1989 | Meyer | 70/427 |
| 4,885,953 | A * | 12/1989 | Sweetland et al. | 74/606 R |
| 5,555,752 | A * | 9/1996 | Fitzpatrick | 70/159 |
| 5,711,468 | A * | 1/1998 | Shoemaker | 224/251 |
| 2004/0256415 | A1 * | 12/2004 | Anjanappa et al. | 222/327 |
| 2008/0295553 | A1 * | 12/2008 | Tsuchikiri et al. | 70/252 |
| 2010/0301691 | A1 * | 12/2010 | Cors et al. | 310/83 |

OTHER PUBLICATIONS

Turnkey Direct Drive System. Datasheet [online]. Shore Commander, Mar. 23,2010 [retrieved Mar. 28, 2013]. Retrieved from the internet: <URL: http://shorecommander.com/>.*
Shore Commander, Shore Commander, catalog brochure, Shore Commander, Nicollet, Minnesota, United States of America.

* cited by examiner

*Primary Examiner* — Vinh Luong
*Assistant Examiner* — Yamilka Pinero Medina

(57) ABSTRACT

A boat lift drive housing for containing a control box, electric motor and gear head for raising and lowering a boat lift. The housing includes front and rear coaxial openings for access to the gear head. The housing further includes an eyebrow cantilevered over an opening in the housing through which a key switch extends such that the key switch is protected from the sun, rain, snow and ice. The housing further includes a pair of bottom openings, with one bottom housing permitting access to a drive shaft of the electric motor and with the other bottom opening holding a tool for driving the drive shaft of the electric motor. The housing further includes a shape tailored to the control box, electric motor and gear head to minimize extra connections within the housing.

10 Claims, 7 Drawing Sheets

BOAT LIFT DRIVE HOUSING APPARATUS

FIELD OF THE INVENTION

The present invention relates to a boat lift drive housing having therein a control box, an electric motor and a gear head, where the housing enhances operation of each of the control box, electric motor and gear head by shielding the key switch of the control box from the elements, by storing a tool for operation of the electric motor at a weather proof location, by permitting access to the gear head from the front and rear of the housing to eliminate opening of the housing during set up, and by tailoring the housing to fit each of the control box, electric motor and gear head.

BACKGROUND OF THE INVENTION

A boat lift drive is a mechanism for lifting up and letting down a boat lift. A hand powered winch is a common boat lift drive. A hand operated winch can be replaced by an electric boat lift drive.

Whether powered by hand or by an electric motor, a boat lift drive is subject to the elements. It is rained and snowed upon. It collects ice. It stops the wind and the dirt in the wind.

Whether powered by hand or by an electric motor, a boat lift drive is likely set up on a dock next to a boat lift. Usually the boat lift drive remains outside in the elements for its entire product life. It may break down. It may be replaced by a newer model. It likely remains in a permanent position next to the boat lift throughout the four seasons, even during winter.

SUMMARY OF THE INVENTION

A feature of the present invention is the provision in a boat lift drive housing having therein a control box, an electric motor, and a gear head, of front and rear openings for the gear head such that the housing may remain closed during installation and such that, if desired, the boat lift drive housing can be easily deinstalled, with the housing remaining closed, such as during the winter months.

Another feature of the present invention is the provision in a boat lift drive housing having therein a control box, an electric motor, and a gear head, of an eyebrow over the key switch that turns the boat lift drive on and off, such that the key switch is shielded from rain, snow, ice, the sun, the wind, and dirt in the wind.

Another feature of the present invention is the provision in a boat lift drive housing having therein a control box, an electric motor, and a gear head, of a grip for a socket that can operate the boat lift drive in an emergency, where the grip is disposed at a location that minimally detracts from weather proof attributes of the boat lift drive housing.

Another feature of the present invention is the provision in a boat lift drive housing having therein a control box, an electric motor, and a gear head, of a housing tailored to the inner contents of the housing to firmly hold in place the control box, electric motor, and gear head and to minimize extra connections within the housing.

An advantage of the present invention is a longer product life. One feature contributing to this advantage is the provision of the front and rear openings that confront the gear head to permit installation without opening the housing, such that the front and rear housing portions need not be separated, such that a factory seal may be placed between the front and rear housing portions, such that the seal need not be broken, and such that a user does not tinker with the operating systems inside of the housing. Other features contributing to this advantage are the provisions of an eyebrow over the key switch, a first cover over the key switch, and a second cover over the first cover, such that collection of water, ice, snow, and dirt in the keyhole of the key switch is minimized. Another feature contributing to this advantage is the location on the bottom of the housing for a grip for a socket that operates the boat lift drive in an emergency, since the bottom of the housing is less likely to collect water, ice, dirt and snow.

Another advantage of the present invention is safety. Since the boat lift drive can be installed and deinstalled without opening the housing, chances are minimized that a user will open up the housing. Thus, chances are minimized that the user will come into contact with the electrical system and gear system of the boat lift drive.

Another advantage of the present invention is speed of installation and deinstallation. Since the housing does not need to be split apart, set up time and take down time is minimized.

Another advantage of the present invention is that chances are maximized that the boat lift drive will work almost every time that the key switch is operated. A first feature contributing to this advantage is the eyebrow that operates as a shield. A second feature contributing to this advantage is the first key switch cover. A third feature contributing to this advantage is the second cover that covers the key switch cover. A fourth feature contributing to this advantage is the factory seal and the gear head access openings in the front and rear of the housing, such that the operating systems in the housing are minimally exposed to user intervention and such that the factory seal remains intact to keep out rain, ice, snow and dirt.

DETAILED DESCRIPTION

Figure 1A:
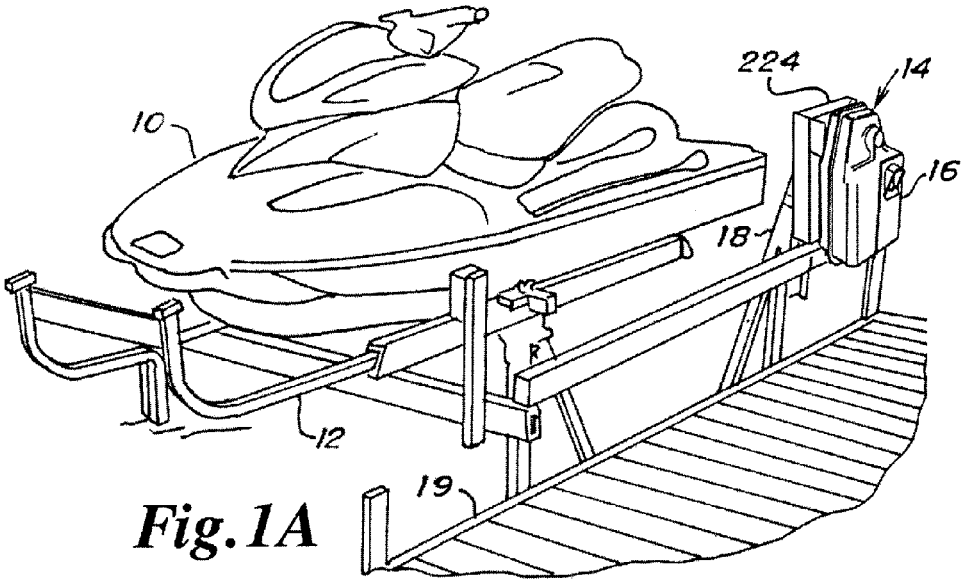
FIG. 1A is a perspective view of a boat, a boat lift, a dock and the present drive assembly housing having a drive assembly therein and being engaged to a winch box.

FIG. 1A shows a boat 10 on a boat lift 12. A portion of the boat lift 12 is released into the water and drawn out of the water by a electrically operated drive assembly 14 contained within a weather proof drive assembly housing 16. Housing 16 is molded plastic. A winch frame 18 supports a winch box 224 that in turn supports the electrically operated drive assembly 14 and housing 16, and the winch frame 18 in turn may be supported by a dock 19 and/or portions of the boat lift 12. Portions of the boat lift 12 may be fixed and supported by one or more of the winch frame 18 and dock 19 and other portions of the boat lift 12 are movable, slideable or liftable relative to the portions of the boat lift 12 that are fixed. A cable extends between a spool driven by the electrically operated drive assembly 14 and portions of the boat lift 12 that are movable, slideable or liftable, and a pulley system may engage the cable between the spool driven by the electrically operated drive assembly 14 and the portions of the boat lift 12 that are movable, slideable or liftable. The cable is wound up onto and wound out from the spool driven by the electrically operated drive assembly 14. The spool is turned by operating the electrically operated drive assembly 14.

Figure 1B:
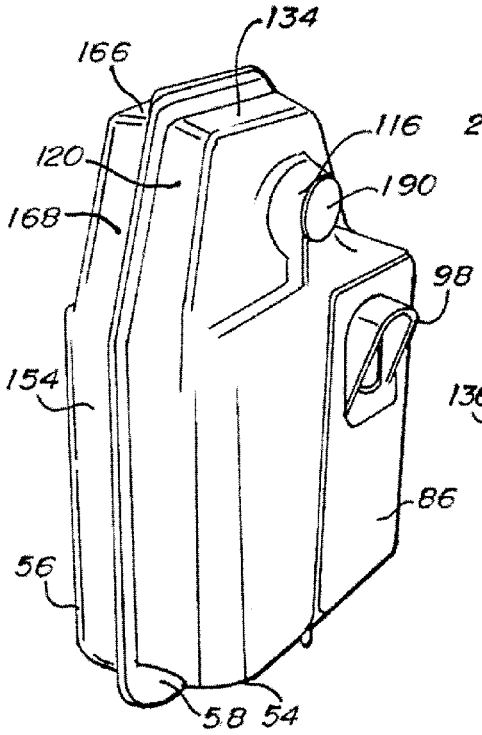
FIG. 1B is a perspective view of the drive assembly housing of FIG. 1A.
Figure 1C:
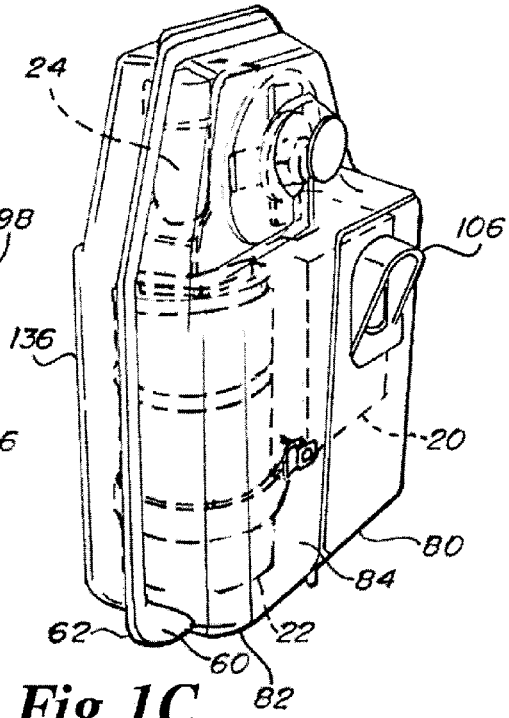
FIG. 1C is a perspective view of the drive assembly housing of FIG. 1B showing the drive assembly therein in phantom.
Figure 3A:
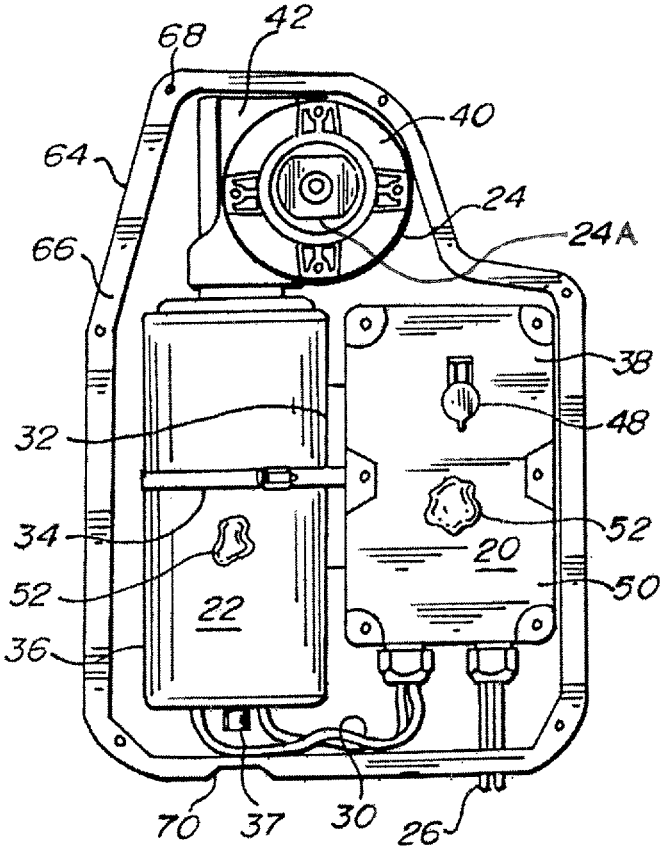
FIG. 3A is a plan view of the drive assembly housing of FIG. 1B with a top half of the drive assembly housing having been removed.
Figure 3B:
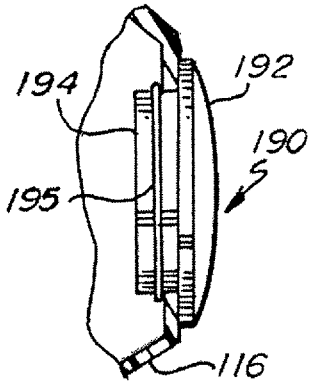
FIG. 3B is a partially section, detail view of the plug for the gear head drive shaft opening shown in FIGS. 2A and 2B.

As shown in FIGS. 1C and 3B, the drive assembly 14 includes a control box 20, a motor 22 and a gear head 24. Control box 20 switches on and off motor 22, which in turn drives gear head 24, which in turn drives the spool in the winch box 224 to wind up and wind out the cable, which in turn lifts up and drops down the boat lift 12.

Figure 4A:
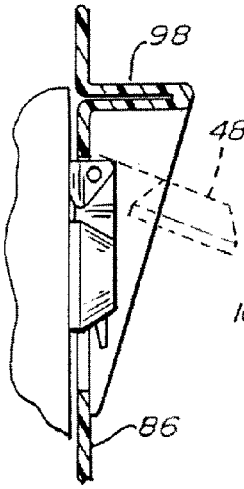
FIG. 4A is a section detail view of the eyebrow covering the key switch and of the keyhole cover of the drive assembly housing of FIG. 1B.
Figure 4B:
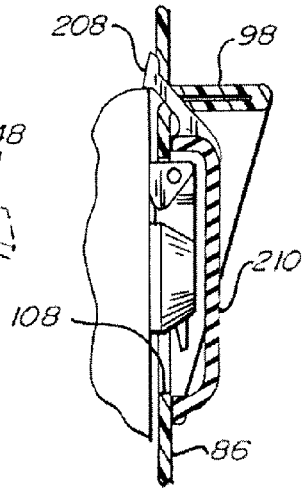
FIG. 4B is a section detail view of an added feature of the drive assembly of FIG. 1B, where the added feature is a living hinge cover for the keyhole cover.
Figure 4C:
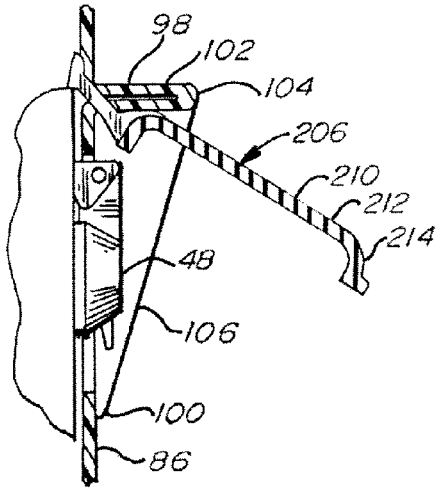
FIG. 4C is a section detail view similar to FIG. 4B, but shows the living hinge cover for the keyhole cover swung back to an out-of-the-position.
Figure 4D:
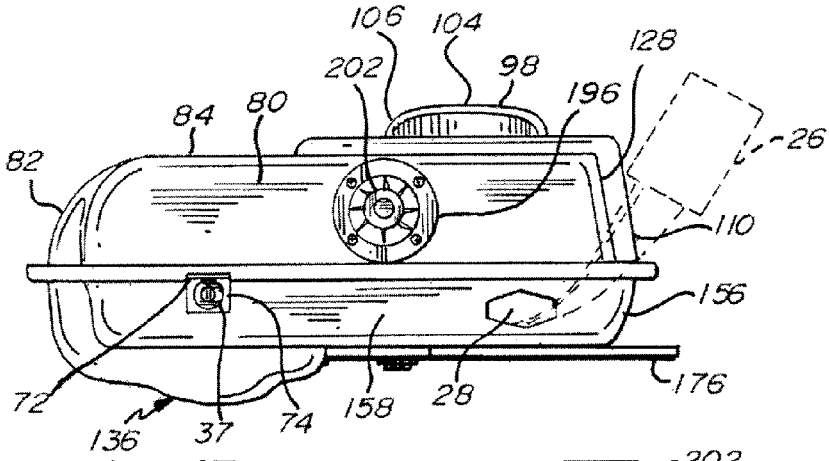
FIG. 4D is a bottom view of the drive assembly housing of FIG. 1B.

An electrical power cord 26 extends from outside the housing 16 through an opening 28 formed in bottom wall section 158 of housing 16, with the opening 28 shown in FIG. 4D. Within the drive assembly housing 16, an electrical cord 30 extends from control box 20 to motor 22.

A U-shaped channel piece 32 is bolted to control box 20. A metal strap 34 is engaged about U-shaped channel piece 32 and motor 22 to secure the control box 20, motor 22 and gear head 24 together as effectively one-piece.

Motor 22 has a cylindrical housing 36. An upper end of the cylindrical housing 36 engages the gear head 24. Electrical cords 30 extend through a lower end of the cylindrical housing 36. A motor drive shaft 37 extends out the lower end of the cylindrical housing 36 for being engaged by a tool such as a drill bit shown in FIG. 4E.

Control box 20 includes a housing 38 that is generally parallelepiped or generally box-shaped or has six face portions. Each face portion extends at a right angle to four other face portions and is parallel to another face portion.

Gear head 24 has a first generally cylindrical portion 40 that houses a gear head drive shaft 24A that drives the winch drive shaft that drives the spool that winds the cable that lifts and lowers the boat lift 12. Gear head 24 has a second generally cylindrical portion 42 that houses a worm gear that is driven by the motor 22 and that in turn drives the gear head drive shaft 24A.

Figure 2A:
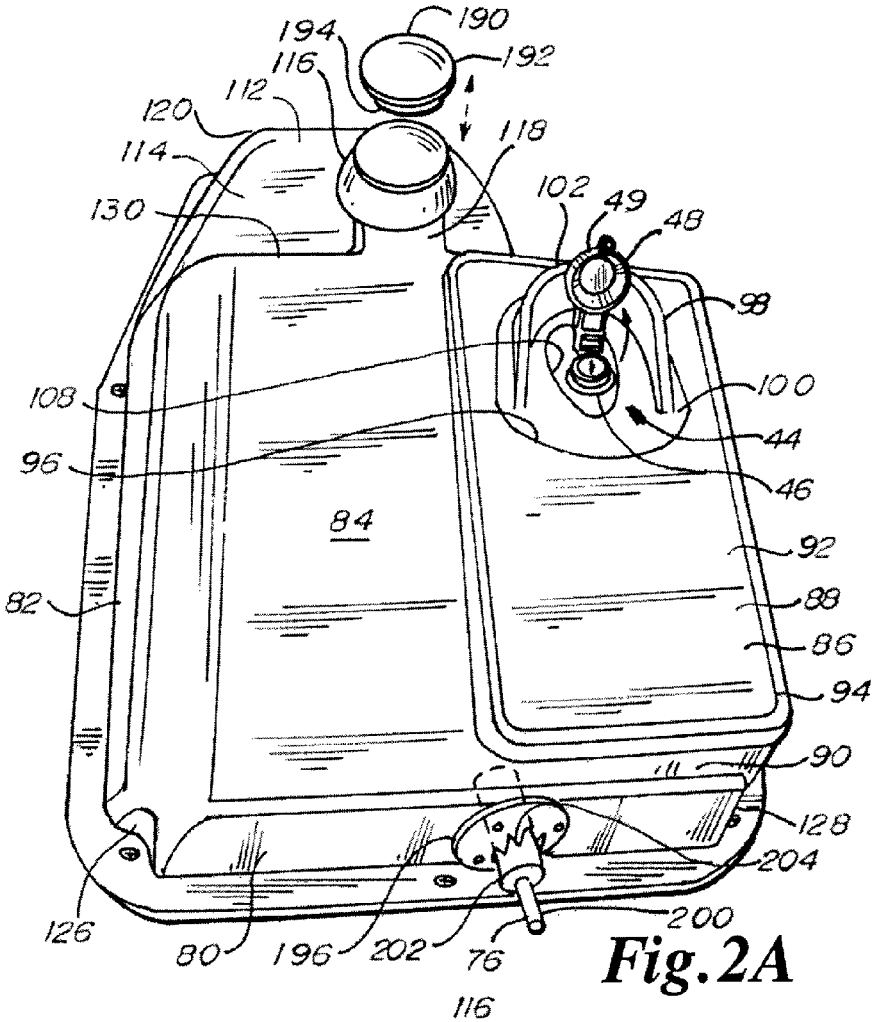
FIG. 2A is a perspective view of the drive assembly housing of FIG. 1A showing a plugged annulus that forms an opening for access to the gear head drive shaft, an eyebrow for a key switch with the key hole cover being open, and a tool holder.
Figure 2B:
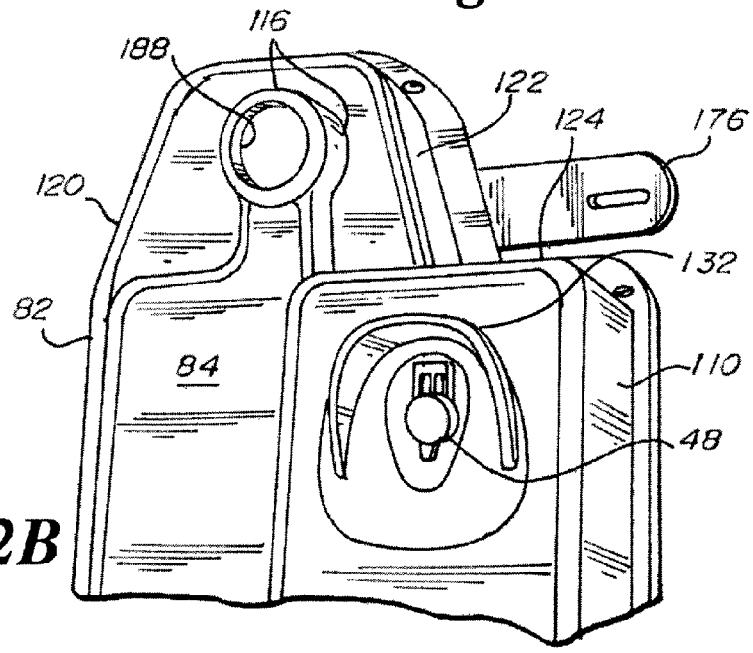
FIG. 2B is a perspective view of the drive assembly housing of FIG. 1B showing an opening for access to the gear head drive shaft and a closed key hole cover.

As shown in FIGS. 2A, 2B and 3B, control box 20 is key operated through a key switch 44. Key switch 44 includes a key hole 46 and a keyhole cover 48 swingable to a covering position that wholly covers key hole 46 and swingable to an out-of-the-way position that permits a key to engage key hole 46 and turn on and off the drive assembly 14. Keyhole cover 48 is spring biased to the covering position such that when keyhole cover 48 is released, keyhole cover 48 automatically returns to the covering position. In other words, to permit a key access to key hole 46, keyhole cover 48 must be held, such as by hand, in an out-of-the-way position. Keyhole cover 48 minimizes access to the key hole 46 by elements such as dirt, rain, water, dust, snow, ice, moisture, and the sun. Control box 22 is turned on by inserting a key into the key hole 46 and turning the key. Control box 22 is turned off by turning the key the opposite way to the off position (vertical position), whereupon the key may be withdrawn from the key hole 46. Turning the key clockwise from the off position raises the boat lift 12. Turning the key counter clockwise from the off position lowers the boat lift 12.

It should be noted that control box 20 includes a front generally flat face 50 and that key switch 44 projects outwardly from the flat face 50, including the portion of the key switch 44 that forms the key hole 46, and including the keyhole cover 48. In other words, keyhole cover 48 includes a distal end portion 49 that is shaped in the form of a receptacle to receive therein outwardly projecting key hole 46. The proximal end portion of the keyhole cover 48 is hinged to a base of the key switch 44, with the base of the key switch being engaged to the control box housing 38. The distal end portion or receptacle 49 includes a frustoconical portion.

Control box 20 includes the electronics for controlling the key switch 44, i.e., for communicating with the motor 22, for turning the motor 22 on, for turning the motor 22 off, for turning the drive shaft 37 of the motor 22 one way, and for turning the drive shaft 37 of the motor 22 the other way. Control box 20 may also include the electronics for communicating with a wireless remote control, such that the boat lift 12 may be operated as one approaches the dock 19 in the boat 10.

Resilient bodies 52 of a gum, glue or adhesive adhere to cylindrical housing 36 and to control box housing 38 to isolate the motor 22 and control box 20 from the housing 16. The bodies 52 are fixed on the front and back of the motor 22 and on the front and back of the control box 20. If desired, the bodies 52 may also be fixed on the front and back of the gear head 24. One body 52 may engage cylindrical housing 36 and the inside of the housing 16. One body 52 may engage control box housing 38 and the inside of housing 16. One body 52 may engage gear head 24 and the inside of housing 16. Body 52 generally takes an irregular shape but may take the shape of a ball, sphere or disk.

As shown in FIGS. 1A, 1B, 1C, 2A, 2B, 3A, 4D, 5A, 5B, 5C, 6A, 6B and 7, drive assembly housing 16 is formed of two molded plastic pieces: a first or front housing portion 54 having a front face and a second or rear housing portion 56 having a rear face. Each of the housing portions 54, 56 takes a receptacle shape. Each of the housing portions 54, 56 includes a depth. Each of the housing portions 54, 56 runs the entire height and width of the housing 16. Each of the housing portions 54, 56 is one-piece and integral. Each of the housing portions 54, 56 is a piece of molded plastic.

First or front housing portion 54 includes a lip 58 running the periphery of the front housing portion 54. The lip 58 is formed of two integral sections: a base section 60 that extends out from housing 16, and a distal section 62 that extends at an angle to base section 60 and that extends rearwardly of base section 60. Lip 58 captures and receives therein a lip 64 running the periphery of the rear housing portion 56. Lip 64 extends out at an angle from housing 16 and can be seen best in FIG. 3A. A seal 66 is engaged between the lips 58 and 64 and runs the periphery of the housing portions 54, 56. Seal 66 is resilient and is pinched between the lips 58, 64 when the lips 58, 64 and their respective housing portions 54, 56 are engaged to each other by pin connectors such as screws engaging peripheral openings 68. As shown in FIG. 3A, lip 64 includes a cutout 70 to improve access to motor drive shaft 37. As shown in FIG. 4D, the distal section 62 of lip 58 includes a cutout 72 to also improve access to motor drive shaft 37.

Two structural features minimize moisture and dirt penetrating between the lips 58, 64 of housing portions 54, 56. The first structural feature is the L-shaped receptor formed by the intersection of the base section 60 of lip 58 and the distal section 62 of lip 58. This L-shaped receptor receives the outer edge of the lip 64 and tucks the lip 64 into the lip 58. The outer edge of lip 64 abuts the distal section 62 of lip 58. The second structural feature that minimizes moisture and dirty moisture seeping between the lips 58 and 64 is the seal 66 pinched between flat base section 60 and flat lip 64.

Each of the cutouts 70, 72 confronts an opening 74. Opening 74 is formed in bottom wall section 158 of rear housing portion 56. Opening 74 permits access to motor drive shaft 37 by a tool or drill bit 76 shown in FIG. 4E. Opening 74 is generally square with rounded corners. Opening 74 has a center or axis that is aligned with the axis of the motor drive shaft 37. Opening 74 confronts the end of drive shaft 37 of electric motor 22.

Each of openings 28 and 74 are formed totally within rear housing portion 56. That is, no portion of opening 28 or opening 74 is formed by front housing portion 54.

Front housing portion 54 includes a flat bottom wall section 80, a cylindrical wall section 82, a flat front section 84, a raised front section 86, an intermediate section 90, an eyebrow 98, a right sidewall section 110, a gear head section 112 having a flat section 114 and an annular section 116, a strip section 118, a left upper sidewall section 120, a right upper sidewall section 122, a right medial sidewall section 124, a recessed wall portion 126, a recessed wall portion 128, a left medial wall section 130, and an upper wall section 134.

In the description below, the "z" direction is a direction that runs forwardly and rearwardly, the "x" direction is a lateral direction that runs right and left, and the "y" direction is a longitudinal direction that runs vertically or upwardly and downwardly.

Figure 5A:
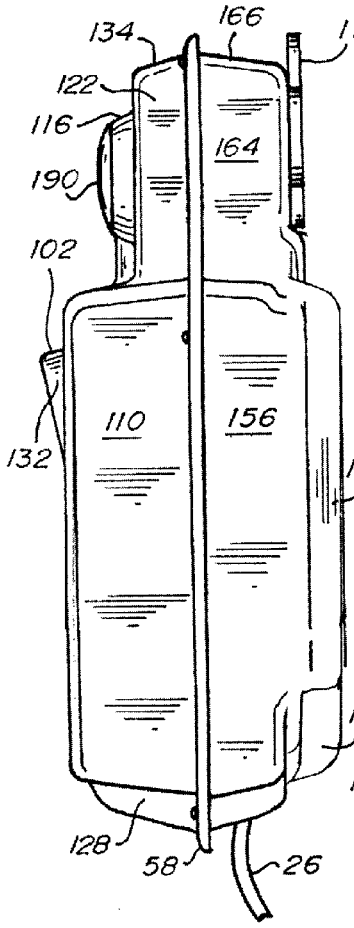
FIG. 5A is a right side view of the drive assembly housing of FIG. 1B.
Figure 5B:
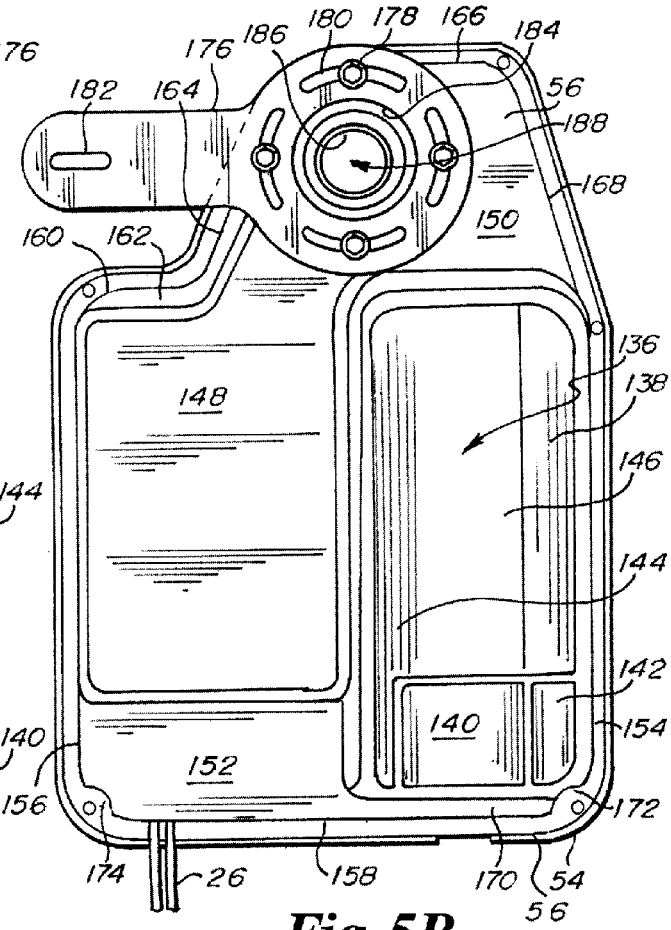
FIG. 5B is a back view of the drive assembly housing of FIG. 1B.
Figure 5C:
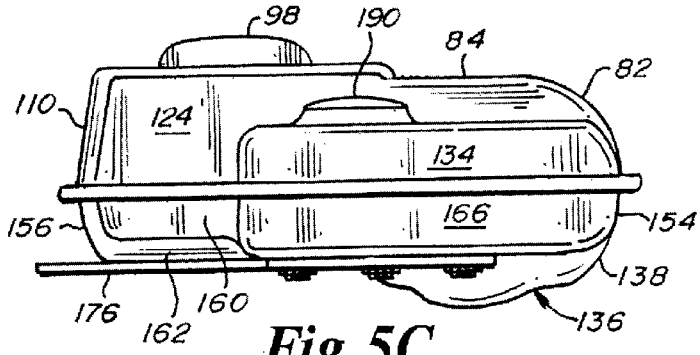
FIG. 5C is a top view of the drive assembly housing of FIG. 1B.
Figures 6A, 6B:
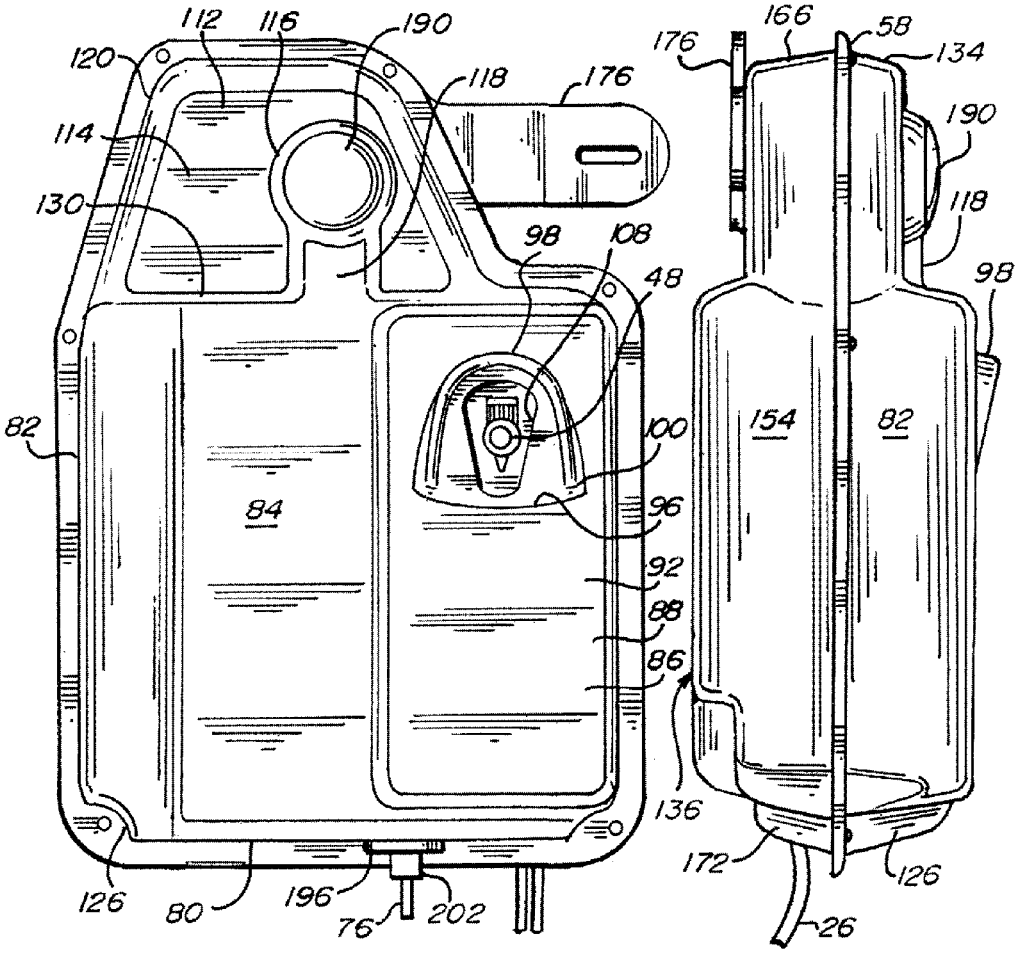
FIG. 6A is a front view of the drive assembly housing of FIG. 1B.
FIG. 6B is a left side view of the drive assembly housing of FIG. 1B.

Flat section or bottom 80 confronts the flat lower end of the motor 22 and the lower end of the control box 20. Flat bottom wall section 80 extends obliquely outwardly from flat section or floor 88, as shown in FIG. 5A. Flat bottom wall section 80 extends in the x direction from cylindrical sidewall 82 and recessed portion 126 to recessed portion 128.

Left sidewall section 82 confronts the motor cylindrical housing 36. Left sidewall section 82 is cylindrical and leads into flat front section 84 in the x direction. Left sidewall section 82 leads into the lip base section 60 in the z direction. Left sidewall section 82 extends in the y direction from recessed wall portion 126 and flat bottom section 80 to medial left wall section 130 and left upper sidewall section 120.

Flat front section 84 confronts a portion of the cylindrical motor 22. Flat front section 84 is disposed between the cylindrical left sidewall section 82 and the raised front section 86 in the x direction. Flat front section 84 is disposed between the flat bottom wall section 80 and the left medial wall section 130 and strip 118 in the y direction. The height of flat front section 84 is about the same as the height of cylindrical left sidewall section 82. The flat front section 84 is generally rectangular in shape.

Raised front section 86 confronts the control box 20. Raised front section 86 extends laterally in the x direction between flat front section 84 and right sidewall section 110. Raised front section 86 extends longitudinally in the y direction from bottom wall section 80 and recessed section 128 to the right medial section 124. A base or floor 88 of raised front section 86 extends in a vertical x, y plane that is disposed forwardly of a vertical x, y plane in which flat front section 84 lies. The height of the raised front section 86 is slightly less than the height of flat front section 84 and the height of the cylindrical left sidewall section 82.

Raised front section 86 includes a stick on graphics sheet 92 having a generally rectangular border 94 and an opening 96. Opening 96 surrounds the key switch 44 and further surrounds an eyebrow 98 that offers protection to key switch 44. Eyebrow 98 is a part of the raised front section 86 and thus is a section of the front housing portion 54. Eyebrow 98 is integral and one-piece with the housing 16. Eyebrow 98 is molded integrally with front portion 54 of the housing 16.

Eyebrow 98 offers protection from the water, rain, ice, snow, the sun, dirt, mud and wayward swinging of paddles and fishing poles. From a front perspective, eyebrow 98 is U-shaped. Eyebrow 98 includes two feet 100. From each of the feet 100, eyebrow 98 extends upwardly and frontwardly to a ceiling section 102. The front edge 104 of ceiling section 102 meets a vertical plane that is set forwardly of the front face of the keyhole cover 48 when the keyhole cover 48 is closed, as shown in FIG. 4C. Eyebrow 98 further includes a pair of tapering edges 106. Each of the tapering edges 106 runs from one of the feet 100 to the ceiling section 102. The tapering edges 106 are disposed in a common plane and this common plane is disposed beyond the keyhole cover 48 such that the keyhole cover 48, the key hole 46, and the key switch 44 as a whole is set within the eyebrow 98. Eyebrow 98 is integral and one-piece with the molded front housing portion 54.

Raised front section 86 includes an opening 108 through which key switch 44, including key hole 46 and key hole cover 48, extends. Opening 108 confronts key switch 44, including key hole 46 and key hole cover 48. Eyebrow 98 covers opening 108 and is cantilevered over opening 108. A bottom edge of the opening 108 is generally at the elevation of the feet 100. An upper edge of the opening 108 confronts the ceiling 102. Side edges of opening 108 are between the tapering edges 106. Side edges of the opening 108 taper downwardly and inwardly toward each other.

Ceiling or roof 102 extends in the x and z directions. Triangular sides 132 of the eyebrow 98 run in the y and z directions. Junctions or corners between the roof 102 and the triangular sides 132 are rounded.

Eyebrow 98 includes a depth. Key switch 44 extends forwardly out of the opening 108. The depth of the eyebrow 98 at the ceiling 102 is greater than a distance that the key switch 44, including the key hole cover 48, extends forwardly out of the opening 108.

Intermediate section 90 is coplanar with flat front section 84. Intermediate section 90 is extends in the y direction between raised flat section 86 and bottom wall section 80.

Intermediate section 90 extends in the x direction between flat front section 84 and recessed portion 128.

Right sidewall section 110 confronts the right side of the control box 20. Right sidewall section 110 runs obliquely outwardly from flat section or floor 88 to lip base section 60, as shown in FIG. 4D. Right sidewall section 110 runs in the y direction from recessed wall portion 128 to right medial sidewall section 122.

Opening 108 includes a top and a bottom. The top of opening 108 confronts the ceiling 102 of eyebrow 98. The bottom of opening 108 confronts the feet 100 of eyebrow 98. The ceiling 102 of eyebrow 98 is disposed at an elevation greater than the top of the opening 108. Sides 132 of eyebrow 98 depend from ceiling 102. Each of the sides 132 includes a bottom or a foot 100. The bottom or foot 100 of the sides 132 confronts the bottom of opening 108. Sides 132 taper forwardly and upwardly from the bottom or feet 100 to the front edge 104 of the ceiling 102.

Gear head section 112 confronts the gear head 24. Gear head section 112 includes a flat section 114 that is generally U-shaped and that lies in a vertical or x,y plane that is disposed rearwardly of the x,y vertical plane in which flat front section 84 lies. U-shaped flat section 114 partially surrounds a partially annular section 116 that projects forwardly of the U-shaped section 114. Partially annular section 116 is tied to flat front section 84 by a strip 118 that is coplanar with flat front section 84. Annular section 116 projects forwardly in the z direction of each of U-shaped section 114 and strip 118. U-shaped section 114 leads into right medial sidewall section 124 on one side and leads into left medial wall section 130 on the other side.

Left upper sidewall section 120 extends at a right angle from lip base section 60 to U-shaped section 116. Left upper sidewall section 120 extends at an oblique angle from cylindrical wall section 82 to upper wall section 134.

Right upper sidewall section 122 extends at a right angle from lip base section 60 to U-shaped section 116. Right upper sidewall section 122 extends at an oblique angle from right sidewall section 110 to upper wall section 134.

Left and right upper wall sections 120, 122 of front housing portion 54 taper toward each other such that sections 120, 122 taper inwardly and upwardly. Left and right upper wall sections 164, 168 of rear housing portion 56 taper toward each other such that section 164, 168 taper inwardly and upwardly.

Upper wall section 134 extends at a right angle in the z direction from lip base section 80 to U-shaped section 116. Upper wall section 134 extends in the x direction from left upper wall section 120 to right upper wall section 122.

Right medial sidewall section 124 confronts control box 20. A main portion of right medial section 124 extends obliquely from lip base section 60 to raised front section 86 and runs obliquely relative to flat section 88 of raised front section 86, as shown in FIG. 5A. Another portion of right medial section 124 extends from U-shaped section 116 to raised front section 86. A portion of right medial section 124 extends from upper right sidewall section 122 to the right sidewall section 110. Another portion of the right medial section 124 extends from strip 118 to the right sidewall section 110.

Right medial sidewall section 124 is L-shaped, with an x direction portion running from strip 118 to right sidewall section 110 and a y direction portion running from raised front section 86 to lip base section 80.

Recessed wall portion or first dimple 126 extends between cylindrical sidewall section 82 and bottom flat section 80. Recessed wall portion 128 extends between bottom flat section 80 and right sidewall section 110. Dimples 126, 128 provide a greater space on lip base section 60 for a pin connector hole 68 and a corresponding pin connector or screw.

Second or rear housing portion 56 includes a receiver 136 for receiving and confronting the cylindrical motor 22. Receiver 136 includes a first cylindrical section 138 having an axis extending in the y direction, a second cylindrical section 140 having an axis extending in the y direction, a flat section 142 in an x,y plane, a third cylindrical section 144 having an axis extending in the y direction, and a flat section 146 in an x,y plane and extending between the first cylindrical section 138 and the third cylindrical section 144.

Rear housing portion 56 further includes a flat section 148 for confronting the control box 22, a flat section 150 for confronting the gear head 24, a lowered flat section 152, a left sidewall 154, a right sidewall 156, a bottom sidewall 158, a medial sidewall 160, a step 162, a right oblique sidewall 164, an upper sidewall 166, a left oblique sidewall 168, a transition section 170, a left corner recessed portion 172, and a right corner recessed portion 174.

Receiver 136 projects rearwardly from flat sections 148 and 150. Receiver 136 is disposed opposite of cylindrical section 82. Receiver 136 is also disposed opposite of flat section 84. Receiver 136, left sidewall 154, cylindrical section 82, bottom wall section 80, and flat section 84 form a retainer or pocket for cylindrical motor 22. FIG. 2B shows in phantom the location of the motor 22 within the housing 16.

An upper portion of the cylindrical section 138 extends from the left sidewall 154 in the z direction and then extends into the flat section 146 in the x direction. A lower portion of the cylindrical section 138 extends from the left sidewall 154 in the z direction and then extends into the flat section 142 in the x direction.

Second cylindrical section 140 is disposed in the x direction between flat section 142 and a lower portion of the third cylindrical section 144. The axis of the second cylindrical section 140 extends in the y direction. Second cylindrical section 140 is disposed in the y direction between flat section 146 and transition section 170.

Flat section 148 confronts the rear side of the control box 20. Flat section 148 is generally rectangular. Flat section 148 extends in the x direction between the third cylindrical section 144 and the right sidewall section 156. Flat section 148 extends in the y direction between the lowered (or forwardly placed) flat section 152 and the step 162. Flat section 148 is opposite of raised front section 86 and runs parallel to flat section 88 of raised section 86. Right sidewall section 156 of rear portion 56 extends obliquely outwardly from flat section 148, as shown in FIG. 4D. Flat section 148, left sidewall section 156, right sidewall section 110, flat section 88, and raised front section 86 form a retainer or pocket for the control box 20. FIG. 2B shows in phantom the location of the control box 20 within the housing 16.

Flat section 150 confronts the rear of the gear head 24. Flat section 150 is coplanar with flat section 148. Sidewall sections 164, 166, 168 lead in the z direction to flat section 150. Flat section 150 borders upper portions of cylindrical section 138, flat section 146 and cylindrical section 144. Flat section 150 further extends into flat section 148. Flat section 150, sidewall section 164, sidewall section 166, sidewall section 168, sidewall section 120, sidewall section 122, upper sidewall section 134, and flat section 114 form a retainer or pocket for gear head 24. FIG. 2B shows in phantom the location the gear head 24 within the housing 16.

Lowered (or forwardly placed) flat section 152 is forwardly of flat section 148 to more distinctly form the pocket or retainer sections of rear housing portion 56 for the control box 20 and the motor 22. Forwardly placed flat section 152 is set in an x,y plane that is forwardly of the flat section 148, which is also set in an x,y plane. Motor receiver 136 projects rearwardly of the flat section 148 and of the flat section 152. Forwardly placed flat section 152 extends in the y direction between flat section 148 and bottom sidewall section 158. Forwardly placed flat section 152 extends in the y direction between cylindrical section 144 and right sidewall 156 and recessed section 174. Forwardly placed flat section 152 is opposite of a lower section of raised section 86 and intermediate section 90. Bottom wall section 158 of rear housing portion 56 extends obliquely relative to flat section 148, as shown in FIG. 5A. Bottom wall section 80 of front housing portion 54 and bottom wall section 158 of rear housing portion 56 make up a bottom of housing 16.

FIG. 1B shows that the left sidewall section or cylindrical section 82 of front housing portion 54 is opposite of the left sidewall section 154 of rear housing portion 56. FIG. 1B further shows that left oblique sidewall section 120 of front housing section 54 is opposite of left oblique sidewall section 168. FIG. 1B further shows that upper sidewall section 134 of front housing portion 54 is opposite of upper sidewall section 166 of rear housing portion 56. In like manner, right oblique sidewall section 122 of front housing portion 54, shown in FIG. 2B, is opposite of right oblique sidewall section 164 of rear housing portion 56, shown in FIG. 5B. Also in like manner, oblique medial sidewall section 124 of front housing portion 54, shown in FIG. 2B, is opposite of oblique medial sidewall section 160, shown in FIG. 5B. Medial sidewall section 160 runs obliquely relative to flat section 148, as shown in FIG. 5A. Also in like manner, oblique right sidewall section 110 of front housing portion 54, is opposite of oblique right sidewall section 156 of rear housing portion 56, shown in FIG. 5B. Also in like manner, oblique bottom wall section 80 of front housing portion 54, shown in FIG. 2A, is opposite of oblique bottom wall section 158 of rear housing portion 56, shown in FIG. 5B.

A tear drop shaped metal bracket 176 is anchored to the gear head 24. Bracket 176 aids in the engagement of drive assembly 14 as a whole to winch box 224 of winch frame 18. Flat section 150 is pinched between the gear head 24 and the tear drop shaped bracket 176. Bracket 176 is rotatably engaged to gear head 24 via pin connectors 178 cooperating with concentric circular slots 180. A gear head drive shaft 24A extending in the z direction through gear head 24 is one connection to the winch box 224 of the winch frame 18. Gear head drive shaft 24A of the gear head 24 engages the exterior of the drive shaft of the winch box 224. A safety bolt 218, shown in FIG. 7, extends through gear head drive shaft 24A and into the interior of the drive shaft of the winch box 224. This safety bolt 218 is a second connection to the winch box 224. Another pin connector extending in the z direction through distal slot 182 formed in a distal end of bracket 176 is a third connection to the winch box 224 of the winch frame 18. Bracket 176 lies in an x,y plane.

Housing 16 with drive assembly 14 therein is likely set outside in a position fixed to the winch box 224 of the winch frame 18 for its entire lifetime as a working product. Thus, housing 16 is subject to the elements such as the sun, rain, wind, dirt, ice and snow. Housing 16 best keeps its contents dry and clean if sealed at the factory. Housing 16 provides access to the gear head 24 at two locations: first, through the flat section 150 in the rear housing portion 56 and, second, through the annular section 116 of the front housing portion 54.

As to the rear housing portion location providing access to the gear head 24, it should be noted that metal bracket 176 includes an inner circular edge 184. This inner circular edge 184 is flush with a circular edge of a rear opening formed in flat section 150. It should be noted that gear head 24 includes a gear head drive shaft receiver 186 that receives and drives the gear head drive shaft 24A that in turn is engaged to the exterior of the winch shaft of the winch box 224 of the winch frame 18. This rear housing location, namely the rear opening formed in flat section 150 having the edge that is flush with circular edge 184 of metal bracket 176, provides access to the gear head 24, and this access is available without opening up the housing 16. This rear opening that is flush with circular edge 184 is coaxial with front opening 188. This rear opening that is flush with circular edge 184 confronts gear head 24 and is coaxial with gear head drive shaft receiver 186 and the gear head drive shaft 24A.

As to the front housing portion location, as shown in FIG. 2B, annular section 116 forms a front opening 188 confronting gear head 24, gear head drive shaft receiver 186, and the gear head drive shaft 24A. Front opening 188 is coaxial with opening 186, gear head drive shaft receiver 186 and the gear head drive shaft 24A that is engaged in the gear head drive shaft receiver 186.

Front opening 188 is closed and sealed with removable lock cap plug 190. Plug 190 includes a head 192 and a shaft 194. Head 192 is of a greater diameter than the diameter of opening 188 and seals the front opening 188 when shaft 194 is snapped onto the edge of the annular section 116 that forms the front opening 188. Shaft 194 is of a lesser diameter than the diameter of front opening 188. To facilitate the snapping action to and from the front opening 188, shaft 194 includes a resilient ring 195 running about the shaft 194 and spaced from the inner flat annular face of the head 192. Ring 195 includes an outside diameter that is slightly greater than the diameter of opening 188 such that plug 190 is pushed with a snapping action into front opening 188, with the ring 195 being compressed when pushed into and drawn out of the front opening 188 to provide the snap fit to the plug 190. The exterior surface of the head 192 is spherical.

Figure 7:
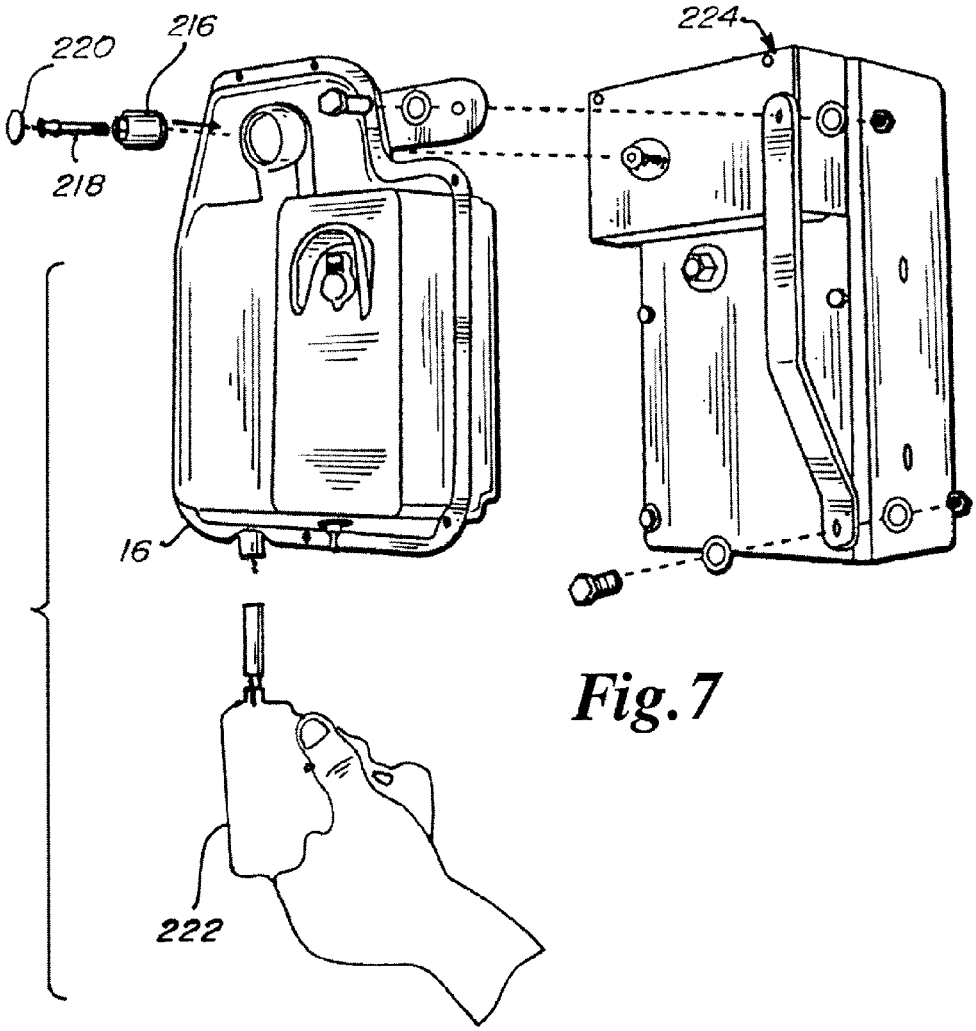
FIG. 7 is a perspective view of the drive assembly housing of FIG. 1B about to be engaged to a winch box, shows how the front access opening to the gear head is exploited, and shows that a cordless drill may be used to turn a socket to turn the motor to turn the gear head to raise and lower the boat lift.

When setting up the drive assembly 14 for the first time, the housing portions 54, 56 do not need to be taken apart, but can remain factory sealed to each other. This is so because plug 190 can be removed to allow aluminum lock cap 216 and safety bolt 218 to be inserted through opening 188, where aluminum lock cap 216 is engaged to the gear head drive shaft 24A and where the safety bolt 218 is inserted through the gear head drive shaft 24A and into the winch box drive shaft, as shown in FIG. 7. Then the plug 190 is snapped back onto the annular section 116. The distance in the z or depth direction or axial direction between ring 195 and the underside of head 192 is about the same as the thickness of the housing 16 such that plug 190 fits tight on housing 16 with no movement in the z direction, or any other direction, when the plug 190 is engaged such that plug 190 seals opening 188.

Flat bottom wall section 80 includes a bottom housing opening therein and an elastomeric grip or trap or quick connect holder 196 engaged over and confronting the bottom housing opening with pin connectors fastened to bottom wall section 158. Grip 196 is generally formed in the shape of a disk and includes a grip opening that communicates with the bottom housing opening in section 80. Grip 196 holds tool 76 therein. Tool 76 includes a shaft 200 and a socket 202. A drill such as a cordless drill engages the shaft 200, and socket 202 engages motor shaft end 37 so as to drive the motor 22, which in turn drives the gear head 24, which in turn drives the gear head drive shaft receiver 186 and the gear head drive shaft 24A therein, which in turn rotates the winch drive shaft and spool for lifting or letting down the boat lift 12.

Grip or trap 196 includes a set of resiliently flexible teeth 204. Each of the teeth 204 is integral and one-piece with the resilient grip 196. Each of the teeth 204 has a relatively wide base or proximal end and a relatively narrow distal end. Each of the teeth 204 has a pair of sides that taper inwardly toward each other from the relatively wide base to the relatively narrow distal end. The base of the teeth 204 define or confront a perimeter or circle or circular opening having a diameter greater than the diameter of the socket 202. Grip 196 defines a circle of teeth 204. The distal ends of the teeth 204 confront each other and define an opening having a diameter less than the diameter of the socket 202. The distal ends of the teeth 204 confront each other when the tool 76 is not engaged in the grip 196.

Figure 4E:
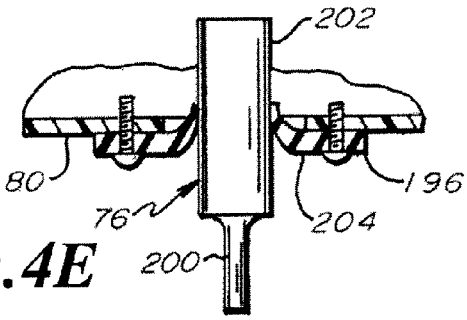
FIG. 4E is a section detail view of a tool holder mounted on the bottom of the drive assembly housing, with the tool holder holding a tool, namely, a bit for a drill, where the bit mates with the drive shaft of the motor.

When the socket 202 is pushed into the grip 196, the teeth 204 resiliently flex inwardly, i.e., bend backwardly and inwardly and upwardly into the housing 16, as shown in FIG. 4E. At the same time, the resilient teeth 204 as a whole squeeze against the metal socket 202. At the same time, the teeth 204, which are formed of an elastomeric or rubber or rubber like resilient material, provide a friction fit for the socket 202. Then the tool 76 can be released and the grip 196 holds the tool 76 against the force of gravity. To take the tool 76 out of the grip 196, the tool 76 is pulled downwardly. The teeth 204 resist the downward pull, but resiliently flex and turn outwardly, as shown in FIG. 2A, which permit the tool 76 to be fully pulled out of the grip 196. When the tool 76 is held in the grip 196, the tool 76 extends through the grip opening of the grip 196 and through the bottom housing opening in section 80 over which the grip 196 is fastened. When the tool 76 is held in the grip 196, a portion of the tool 76 is within the housing 16 and a portion of the tool 76 is outside of the housing 16 and visible to the user.

FIG. 4A shows the swinging action of keyhole cover 48. FIGS. 4B and 4C show a supplemental keyhole cover 206. Supplemental cover 206 includes a living hinge 208 anchored in a hole formed underneath eyebrow 98 and extending from inside of housing 16 to outside housing 16 to a location beneath eyebrow 98, where the living hinge 208 is engaged to a receptacle shaped cover 210. In other words, by being receptacle-shaped, cover 210 includes a top 212 and an endless sidewall 214 such that, if turned right side up, cover 210 could hold water. As shown in FIG. 4*b*, unlike key hole cover 48 that returns to a closed position on top of control box 20, opening cover 210 resiliently returns to a closed position outside of opening 108 such that the endless sidewall 214 confronts raised front section 86. In other words, the width and height of opening cover 210 are greater than the width and height of opening 108 so as to minimize water, snow, dirt and other elements from passing into housing 16. Living hinge 208 is resiliently biased to the closed position shown in FIG. 4B. In the open position, cover 206 permits access to cover 48, as shown in FIG. 4C. Opening cover 210 extends over opening 108 and over key switch 44 and key hole 46 to protect the opening 108 and the key switch 44 and key hole 46 from the sun, water, rain, ice and snow.

Gear head 24 includes the gear head drive shaft 24A. The gear head drive shaft 24A is engaged by the gear head drive shaft receiver 186 of the gear head 24. The gear head drive shaft 24A is installed in the gear head 24 through the rear access opening formed in the rear housing portion 56. The proximal end of the gear head drive shaft 24A engages the outside of the drive shaft of the winch box 224 and turns the drive shaft of the winch box 224 that is shown in FIG. 7. FIG. 7 further shows an aluminum lock cap 216 that is installed on the distal end of the gear head drive shaft 24A. Aluminum lock cap 216 is installed on the gear head drive shaft 24A through front access opening 188 of the front housing portion 54. FIG. 7 also shows a safety bolt 218 that extends through the aluminum lock cap 216 and further through the gear head drive shaft 24A. The safety bolt 218 then engages the interior of the drive shaft of the winch box 224. Safety bolt 218 is installed on (or through) the gear head drive shaft 24A and also through front access opening 188 of the front housing portion 74. Element 220 represents the plug 190 described above. FIG. 7 further shows a cordless drill 222 that engages the shaft 200 of tool 76. Tool 76 has socket 202 that engages the motor drive shaft 37 of motor 22.

The Gargaro, III et al. U.S. Pat. No. 7,784,767 B2 issued Aug. 31, 2010 and entitled Boat Lift Drive is hereby incorporated by reference in its entirety.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A boat lift drive housing apparatus in combination with a boat lift drive, wherein the boat lift drive comprises a control box having a key switch, an electric motor, and a gear head, wherein the boat lift drive housing apparatus comprises:

a) a plastic housing, with said plastic housing containing said control box having said key switch, said electric motor and said gear head;

b) wherein said plastic housing comprises a front face and a rear face;

c) wherein said front face of said plastic housing comprises an opening confronting said key switch of said control box;

d) wherein said front face of said plastic housing comprises an eyebrow cantilevered over said opening to shield said opening from the sun, water, rain, ice and snow; and e) wherein said opening includes a top and a bottom, wherein said eyebrow includes a ceiling at an elevation greater than said top of said opening, wherein said eyebrow includes sides depending from said ceiling, each of said sides of the eyebrow having a bottom, each of said bottoms of each of said sides of the eyebrow confronting said bottom of said opening, each of said sides of the eyebrow tapering forwardly and upwardly from said bottom of said side to the ceiling of the eyebrow and defining tapering edges, and the tapering edges of each of said sides being disposed in a common plane such that said common plane is disposed beyond said opening and key switch such that said opening and key switch are set within said eyebrow.

2. The boat lift drive housing apparatus and boat lift drive combination of claim 1, and further comprising said key switch of said control box, with said key switch comprising a key hole cover and a key hole, with said key hole cover covering said key hole to protect said key hole from the sun, water, rain, ice and snow.

3. The boat lift drive housing apparatus and boat lift drive combination of claim 2, and further comprising an opening cover for said opening, with said opening cover extending over said opening and key hole cover to protect said opening and said key hole cover from the sun, water, rain, ice and snow.

4. The boat lift drive housing apparatus and boat lift drive combination of claim 1, and further comprising an opening cover for said opening, with said opening cover extending over said opening and key switch to protect said opening and key switch from the sun, water, rain, ice and snow.

5. The boat lift drive housing apparatus and boat lift drive combination of claim 1, wherein said eyebrow comprises a depth, wherein said key switch extends forwardly out of said opening, and wherein said depth is greater than a distance that said key switch extends forwardly out of said opening.

6. The boat lift drive housing apparatus and boat lift drive combination of claim 1, wherein said eyebrow is integrally molded on said housing.

7. A boat lift drive housing apparatus in combination with a boat lift drive, wherein the boat lift drive comprises a control box, an electric motor having a drive shaft, and a gear head, wherein the boat lift drive housing apparatus comprises:

a) a plastic housing, with said plastic housing containing said control box, said electric motor having a drive shaft and said gear head;

b) wherein said plastic housing comprises a front face, a rear face, and a bottom;

c) wherein said bottom of said plastic housing comprises first and second openings;

d) wherein said first opening of said bottom confronts a drive shaft of said electric motor;

e) wherein said second opening of said bottom confronts a quick connect holder having a third opening, with the second and third openings communicating with each other; and f) a tool for driving said drive shaft of said electric motor, wherein said tool comprises a shaft and a socket, with said shaft being engagable by a drill, with said socket engagable to said drive shaft of said electric motor, and wherein said tool is held by said holder in said second and third openings such that a portion of said tool is within said plastic housing and such that another portion of said tool is outside of said plastic housing to be visible to a user.

8. The boat lift drive housing apparatus and boat lift drive combination of claim 7, wherein the quick connect holder comprises a resilient grip having said third opening.

9. The boat lift drive housing apparatus and boat lift drive combination of claim 8, wherein said resilient grip comprises a circle of teeth, with each of said teeth being resilient and flexible, with each of said teeth having a base and a distal end, with each of the bases confronting a circle having a diameter greater than said socket, with each of the distal ends confronting each other and defining a fourth opening having a diameter less than the diameter of said socket, such that when the socket is pushed into the resilient grip the teeth are flexed upwardly into the housing to resiliently grip and hold the socket.

10. A boat lift drive housing apparatus in combination with a boat lift drive, wherein the boat lift drive comprises a control box, an electric motor, and a gear head, wherein the boat lift drive housing apparatus comprises:

a) a plastic housing, with said plastic housing containing said control box, said electric motor and said gear head;

b) wherein said plastic housing comprises front and rear motor sections for containing said electric motor, with at least one of said motor sections being at least partially cylindrical;

c) wherein said plastic housing comprises front and rear control box flat sections and front and rear side sections for containing the control box, with said front control box flat section running parallel to said rear control box flat section, with said front control box side section running obliquely outwardly relative to said front control box flat section, with said rear control box side section running obliquely outwardly relative to said rear control box flat section; and d) wherein said plastic housing comprises front and rear gear head sections for containing said gear head, with said front and rear gear head sections comprising right and left sides, with right and left sides of the front gear head sections tapering upwardly and inwardly toward each other, and with right and left sides of the rear gear head sections tapering upwardly and inwardly toward each other.

* * * * *